US005123562A

United States Patent [19]

Bullard et al.

[11] Patent Number: 5,123,562

[45] Date of Patent: Jun. 23, 1992

[54] SIDE DISCHARGE TRASH CONTAINER

[75] Inventors: Edward M. Bullard, East Rochester; Paul E. Viscontini, Webster, both of N.Y.

[73] Assignee: Mobil Oil Corporation, Fairfax, Va.

[21] Appl. No.: 460,475

[22] Filed: Jan. 3, 1990

[51] Int. Cl.[5] ..... B65D 43/14

[52] U.S. Cl. ..... 220/334; 220/94 R; 220/661; 220/908; 232/43.1

[58] Field of Search ..... 220/1 T, 4 R, 4 A, 18, 220/334; 232/43.1

[56] References Cited

U.S. PATENT DOCUMENTS

| | | | |
|---|---|---|---|
| D. 270,676 | 9/1983 | Pease . | |
| 652,331 | 6/1900 | Rudolph | 232/43.2 |
| 1,238,993 | 9/1917 | Edwards | 220/1 T |
| 1,511,982 | 10/1924 | Schilling | 40/606 |
| 1,574,685 | 2/1926 | Pacorek | 232/43.1 |
| 1,959,790 | 5/1934 | Katzman | 232/1 |
| 2,907,516 | 10/1959 | Follett et al. | 232/43.1 |
| 3,309,160 | 3/1967 | Lewis | 312/308 |
| 3,964,630 | 6/1976 | Getz | 220/1 T |
| 3,982,407 | 9/1976 | Guenette . | |
| 4,217,073 | 5/1978 | Propst | 414/421 |
| 4,577,778 | 3/1986 | Kim . | |
| 4,643,380 | 2/1987 | Copeland . | |
| 4,676,431 | 6/1987 | Teske et al. | 232/43.1 |

*Primary Examiner*—Stephen Marcus
*Assistant Examiner*—Stephen Cronin
*Attorney, Agent, or Firm*—Alexander J. McKillop; Charles J. Speciale; Michael J. Mlotkowski

[57] ABSTRACT

A trash container for the storage and ready removal of filled disposable garbage bags and receptacles or the like from a side of the container. The trash container is of an essentially frusto-conical configuration narrowing towards an upper end and incorporating an opening or top aperture for the inserton of filled garbage bags or similar refuse, and in which at least one of the upwardly converging container sidewalls includes a wall portion which is pivotably openable so as to enable the discharge of the trash container contents through a side thereof in its lower region.

6 Claims, 1 Drawing Sheet

SIDE DISCHARGE TRASH CONTAINER

BACKGROUND OF THE INVENTION

1. Field of the Invention

The present invention relates to a trash container for the storage and ready removal of filled disposable garbage bags and receptacles or the like from a side of the container.

The utilization of trash containers of a generally rigid construction which enable the filling thereof and storage therein of filled garbage bags and other refuse is widely known and employed for home, office and industrial applications. In particular, many of such trash container structures incorporate top openings which enable the insertion therethrough of filled garbage bags for their storage in the container until it is desired that such bags be collected and removed to other locations for processing and disposal. At such times, in many instances, the filled garbage bags are either lifted out through the top opening in the trash container, or the entire container is raised so as to enable discharge of the bags through an openable bottom of the container. This entails expenditure of a considerable amount of energy in the lifting of the container and/or the contents therein, quite frequently rendering such removal procedures cumbersome and possibly unsanitary or hazardous since the person removing the container contents must reach into the trash container without being able to view the contents and ascertain if they are injurious to the person or environment. Moreover, when it is required to raise the container in order to gain access to the filled garbage bags stored therein, often this necessitates the sliding out of the bags from the raised up bottom wall structure of the trash container, often a physically difficult task in implementing these maneuvers.

In order to gain an easier access to the trash container contents, such as filled garbage bags and other types of refuse, various structures have been proposed in the technology, however, not all of which are suitable for the easy discharge of such bags in a rapid and simple manner from a trash container.

2. Discussion of the Prior Art

Getz U.S. Pat. No. 3,964,630 discloses a garbage can for use with disposable garbage bags or refuse contained therein, in which the can which is of generally rectangular cross-section with a widening bottom region, to which access may be gained by removing the narrower upper portion of the upwardly narrowing container. This will allow for access to a large garbage disposal bag which is suspended within the rigid can, which in turn, provides for storage space for receiving a plurality of filled smaller garbage bags or other refuse. The structure shown in Getz requires an upper lid portion including mounting devices for suspending the large garbage disposal bag thereto, and in addition, if it is desired to empty the can, this necessitates removal of the upper lid structure which restrains the upper edge of the garbage bag, thereafter lifting off the upper conically narrowing portion of the can to expose and gain access to the disposal bag, and thereafter, after removing the full bag, again reassembling the conical portion introducing a new large garbage disposal bag and then fastening the upper edge thereof to the reimposed lid and cover structure. This represents an extremely complex construction necessitating a considerable amount of effort in both assembly and disassembly of the can and disposal bag components. Moreover, the garbage can construction necessitating the use of such separate components renders the entire structure thereof not only complex but extremely expensive in its manufacture and maintenance inasmuch as, generally, such garbage cans are subjected to relatively rough handling during their usage.

Copeland U.S. Pat. No. 4,643,380 discloses a trash bag filling and compacting form, in which an outer container includes a removable cover and a bottom wall structure for supporting garbage bags within an upstanding rigidly-walled container structure. When the container is filled and it is required to remove the garbage bags therefrom, the cover is raised away from the sidewalls of the container, and the sidewalls thereafter are lifted away from the bottom in order to enable the removal of the container contents therefrom. This again necessitates disassembling of the entire container components and separating the latter in order to gain access to the contents thereof from within the bottom region, which is subject to all of the limitations and disadvantages encountered in the above-mentioned Getz patent.

Jorgensen U.S. Pat. No. 4,167,271 discloses a rigid trash container structure in which a frusto-conical sidewall widening towards the bottom of the container, and which rests on a bottom wall, is enabled to be opened so as to allow for gaining access to the container contents, which may be filled garbage bags or the like trash. This structure, although somewhat simpler in nature than the above-mentioned prior art constructions, still necessitates the entire sidewall be opened which could conceivably cause the inadvertent or unintended falling out of the container contents, thereby creating either a hazardous or unsanitary condition for the person removing the contents, especially inasmuch as some of the garbage bags contained therein may split open during the opening of the container, and spill their contents.

Finally, Guenette U.S. Pat. No. 3,982,407; Kim U.S. Pat. No. 4,577,778 and Rudolph U.S. Pat. No. 652,331 all disclose various types of trash container constructions adapted to receive filled garbage bags and the like refuse. However, none of these disclose a container which is in the nature of a frusto-conical configuration narrowing from the bottom upwardly toward the top and having a sidewall providing for the ready removal or side discharge of garbage bags or refuse from the lower interior of the trash container.

SUMMARY OF THE INVENTION

In essence, the present invention has as its object the provision of a trash container for the storage and ready removal of filled disposable garbage bags, in which the trash container is of an essentially frusto-conical configuration narrowing towards an upper end and incorporating an opening or top aperture for the insertion of filled garbage bags or similar refuse, and in which at least one of the upwardly converging container sidewalls includes a wall portion which is pivotably openable so as to enable the discharge of the trash container contents through a side thereof in its lower region.

Still another object of the invention resides in the provision of a trash container of the type described herein, in which the latter is provided with a top lid closure hingedly connected to the upper edge of the upstanding collar wall portion projecting from the upper end of the converging sidewalls, and with at least one of the sidewalls having a major surface portion thereof openable and hingedly connected to an adjacent sidewall to facilitate discharge therethrough of the contents which are stored in the trash container.

BRIEF DESCRIPTION OF THE DRAWINGS

Reference may now be had to the following detailed description of an exemplary embodiment of the side discharge trash container of the invention, taken in conjunction with the accompanying drawings; in which.

DETAILED DESCRIPTION

Figure 2:
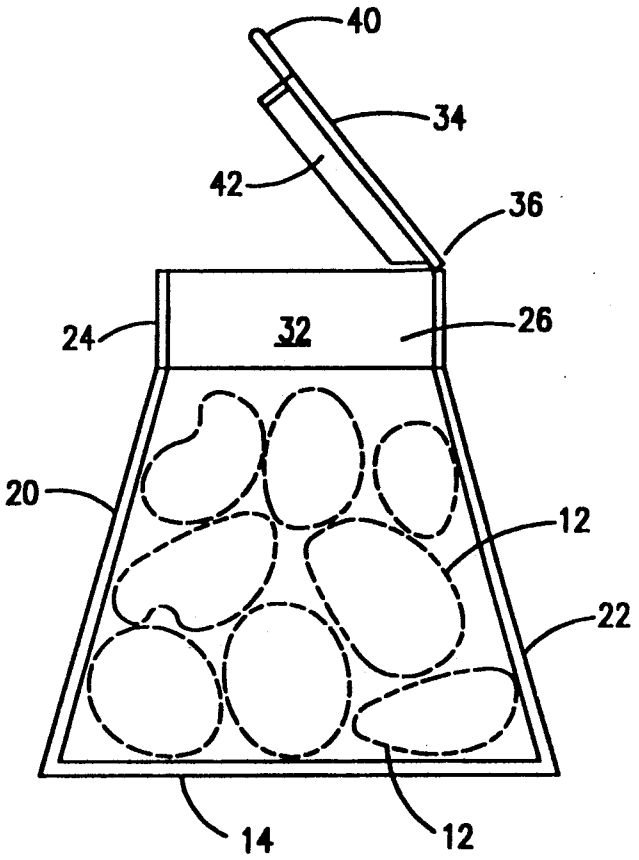
FIG. 2 illustrates a sectional view through the trash container taken generally along line 2—2 in FIG. 1.
Figure 1:
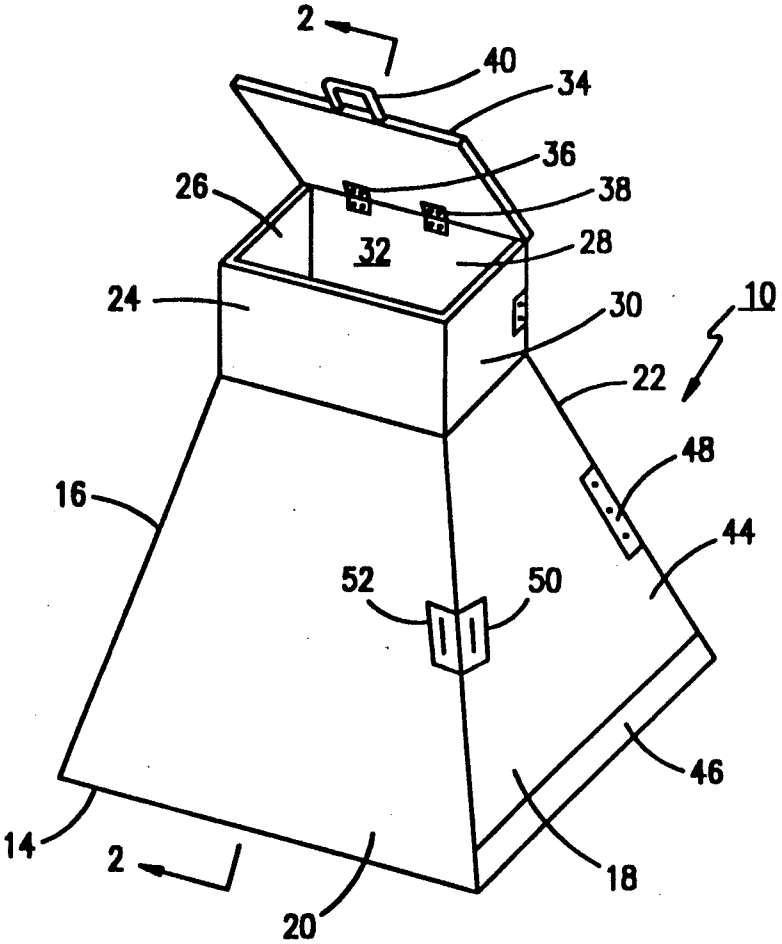
FIG. 1 illustrates in a perspective view, shown in a schematic representation, the trash container for the storage and side discharge of filled disposable garbage bags and refuse, constructed pursuant to the invention.

Referring now in detail to the drawings, there is illustrated a trash container 10 which is adapted for the receipt of a plurality of refuse-filled garbage bags 12, the latter of which may be of any conventional construction consisting of flexible plastic material, as is well-known in the refuse industry.

The trash container 10 may be constructed in any suitable size, dependent upon whether the container is intended for home, office use or industrial applications, in order to be able to receive and store an adequate number of garbage bags 12 in conformance with the specific location for the trash container.

More specifically, the inventive trash container 10, which may be constituted from a suitable molded rigid plastic material, or alternatively, from metal, wood or coated paperboard or the like materials, incorporates a bottom wall 14 which may be flat or slightly upwardly raised in the center portion thereof, as desired. In the illustrated embodiment, the bottom wall is of an essentially flat, rectangular configuration, although it may also be square, polygonal, oval or circular, depending upon the desired configuration for the trash container. Extending upwardly so as to converge from their juncture with the peripheral edges of the bottom wall 14 are a plurality of adjoining sidewalls 16, 20 and 22 of the container. The sidewalls 16, 20 and 22 are joined to each other along their contiguous edges so as to form an integral or unitary structure. The upper end of the sidewalls extend into vertically projecting wall portions 24, 26, 28 and 30, and in which the lower edges of each of the wall portions 24, 26, and 28 are fixedly joined with the upper edges of the adjoining converging wall portions 20, 16 and 22.

Hereby, the upper wall portions 24 through 30 define a neck portion or rectangular collar forming a top aperture 32 for the insertion therethrough of filled garbage bags into the interior of the trash container 10. The aperture 32 may be readily closed off by means of a lid 34 which is hingedly connected to the upper edge of the wall portion 28 through the intermediary of one or more suitable hinges 36, 38 of generally conventional construction, such as in the nature of piano-type hinges or the like. The lid 34 may be provided with a suitable gripping handle 40 at its free edge opposite the hinges 36 and 38 so as to facilitate the opening and closing of the lid 34 as desired. Moreover, as shown in FIG. 2, the peripheral edges of the lid 34, except the edge containing the hinges 36, 38 may be provided with a depending flange structure 42 for encompassing in superposition at least the upper section of the sidewall portions 24, 26 and 30 so as to enable the formation of a seal with the underlying sections or these wall portions during the storage of garbage bags within the trash container 10.

In order to facilitate the discharge of the filled garbage bags or refuse from the trash container 10, without the necessity for having to either open the upper end of the trash container or having to lift the latter, the sidewall 18 is provided with a wall portion 44 which may constitute almost the entire sidewall with the exception of a lower bottom edge 46 connecting to the bottom wall 14, and whereby the sidewall portion 44 is provided with one or more hinges 48 hingedly connecting the wall portion 44 with the adjacent edge of the sidewall 22. The opposite edge of the wall portion 44 may be provided with a latch member 50 which is engagable with a complementary latch element 52 on the adjacent edge of the sidewall 20, such latch being of any conventional construction well-known art. Thus, during the filling of the trash container 10 with garbage bags 12 through the upper aperture 32, and during the storage of such garbage bags in the container, the sidewall portion 44 is in a normally closed condition with the latch members 50, 52 being interengaged so as to provide a closed lower portion for the trash container 10. When it is desired to remove the contents from the trash container 10, it is merely necessary to unlatch the latch members 50, 52 from each other, and to swing the sidewall portion 44 open about the hinge structure 48, thereby forming a side discharge opening in the trash container facilitating the ready removal of the contents therefrom. If desired, the upper wall portion 30 may also be hingedly connected to the adjacent upper wall portion 28, and provided with a latch analogous to latch members 50, 52 connecting the upper wall portion 30 with the upper wall portion 24. This will enable opening the entire side of the trash container 10 to allow for easy discharge of the contents thereof without having to disassemble any components of the container or having to lift the latter during the refuse content-removing procedure.

Thereafter, subsequent to the emptying of the trash container 10, it is merely necessary to close the sidewall portion 44 and to latch the latter to the sidewall 20 by means of the interengagement of latch members 50, 52; and in the event that the upper wall portion 30 is also of a hinged construction, to similarly effect this procedure therewith.

From the foregoing, it becomes readily apparent that the entire trash container construction is simple and inexpensive in nature, possessing a wide versatility and necessitating minimum effort in filling thereof with garbage bags or refuse while enabling the ready side discharge from the lower region of the trash container 10.

In addition to the foregoing, although only disclosed with regard to a generally rectangular configuration, the trash container 10 may be imparted any suitable configuration in cross-section, such as essentially cylindrical, square, polygonal and the like.

Furthermore, when employed for home or office use, the exterior surfaces of the trash container 10 may be embossed or imprinted with suitable decorative and identifying indicia and legends, and the surfaces also imparted colorings so as to render the containers commercially attractive to consumers.

While there has been shown and described what are considered to be preferred embodiments of the invention, it will, of course, be understood that various modifications and changes in form or detail could readily be made without departing from the spirit of the invention. It is therefore intended that the invention be not limited to the exact form and detail herein shown and described, nor to anything less than the whole of the invention herein disclosed as hereinafter claimed.

What is claimed is:

1. A trash container for the storage and discharge of filled disposable garbage bags and refuse, said container having a generally rigid wall structure including a bottom wall, converging sidewalls extending upwardly from juncture with the edges of said bottom wall so as to form a frusto-conical sidewall structure; parallel wall portions extending upwardly from the upper ends of said sidewalls to form a top inlet aperture at the upper end of said trash container for the insertion therein of filled disposable garbage bags; a lid hingedly connected to one upper edge of the upper wall portion of said container to facilitate closing said aperture; and at least one of said converging sidewalls having a wall portion hingedly connected with an adjacent converging sidewall so as to enable pivotal opening of said wall portion providing for side discharge of said filled disposable garbage bags from said container.

2. A trash container as claimed in claim 1, wherein said parallel wall portion of said container located above said openable sidewall portion is hingedly connected with an adjacent parallel wall portion to enable opening thereof contiguously with the opening formed by said sidewall portion.

3. A trash container as claimed in claim 1, wherein said container bottom wall is of rectangular configuration, four of said sidewalls extending upwardly from the respective edges of said bottom wall, said upper parallel wall portions forming a rectangular inlet aperture for said garbage bags, said lid being rectangular so as to conform with said inlet aperture; and hinge means connecting one edge of said lid with the upper edge of an adjacently located upper wall portion of said container.

4. A trash container as claimed in claim 3, wherein said openable sidewall portion includes hinge means connecting one side edge thereof with an adjoining sidewall, and latch means on the opposite side edge of said openable sidewall for releasable engagement with a complementary latch means on the sidewall adjacent said opposite side edge for latching said openable sidewall portion into a container-closing position during the filling of said container with and storage of said garbage bags.

5. A trash container as claimed in claim 3, wherein said bottom wall and sidewalls are of a square configuration in horizontal cross-section.

6. A trash container as claimed in claim 1, wherein said container is constituted from a rigid, molded plastic material.

* * * * *